United States Patent [19]

Knauer

[11] Patent Number: 4,779,859

[45] Date of Patent: Oct. 25, 1988

[54] ADJUSTABLE PAPER WEB FOLDING FORMER

[75] Inventor: Peter Knauer, Rain am Lech, Fed. Rep. of Germany

[73] Assignee: MAN Roland Druckmaschinen AG, Augsburg, Fed. Rep. of Germany

[21] Appl. No.: 68,945

[22] Filed: Jul. 1, 1987

[30] Foreign Application Priority Data

Jul. 24, 1986 [DE] Fed. Rep. of Germany ..... 3624990

[51] Int. Cl.[4] ..... B41L 43/04; B65H 23/32

[52] U.S. Cl. ..... 270/41; 266/199

[58] Field of Search ..... 270/41, 40, 5; 226/197, 226/199; 493/338–340

[56] References Cited

U.S. PATENT DOCUMENTS

| | | | |
|---|---|---|---|
| 879,443 | 2/1908 | Cottrell | 270/41 |
| 934,368 | 9/1909 | Stewart | 270/41 |
| 1,574,789 | 3/1926 | Burgess . | |
| 1,884,783 | 10/1932 | Marcalus . | |
| 2,014,076 | 9/1935 | Crafts | 270/41 |
| 2,014,307 | 9/1935 | Bourdes et al. | 270/41 |
| 2,050,767 | 8/1936 | Seaman et al. . | |
| 2,322,647 | 6/1943 | Luce | 270/41 |
| 4,607,830 | 8/1986 | Schumann | 270/41 |

FOREIGN PATENT DOCUMENTS

| | | |
|---|---|---|
| 2808483 | 9/1978 | Fed. Rep. of Germany . |
| 3506772 | 6/1986 | Fed. Rep. of Germany . |
| 916336 | 8/1986 | France . |

*Primary Examiner*—Eugene H. Eickholt

*Attorney, Agent, or Firm*—Frishauf, Holtz, Goodman & Woodward

[57] ABSTRACT

To provide for a horizontal offset (x) of the apex of a folding triangle former (2,42), the former triangle, together with a substrate removal or run-out roller (11,51) is movable in a plane positioned at the angle of inclination ($\alpha$) of the folding former, for example by interengagement of projection-and-recess means formed on a frame (5,45) holding the former triangle in sidewalls (11,12;52,53) of the apparatus, the recess extending, for example in the form of an elongated slot, at the angle of inclination of the folding former.

13 Claims, 4 Drawing Sheets

Fig. 1
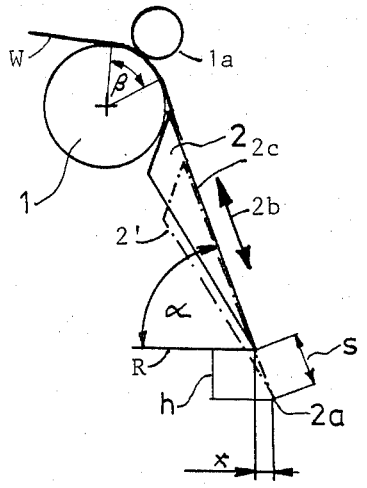
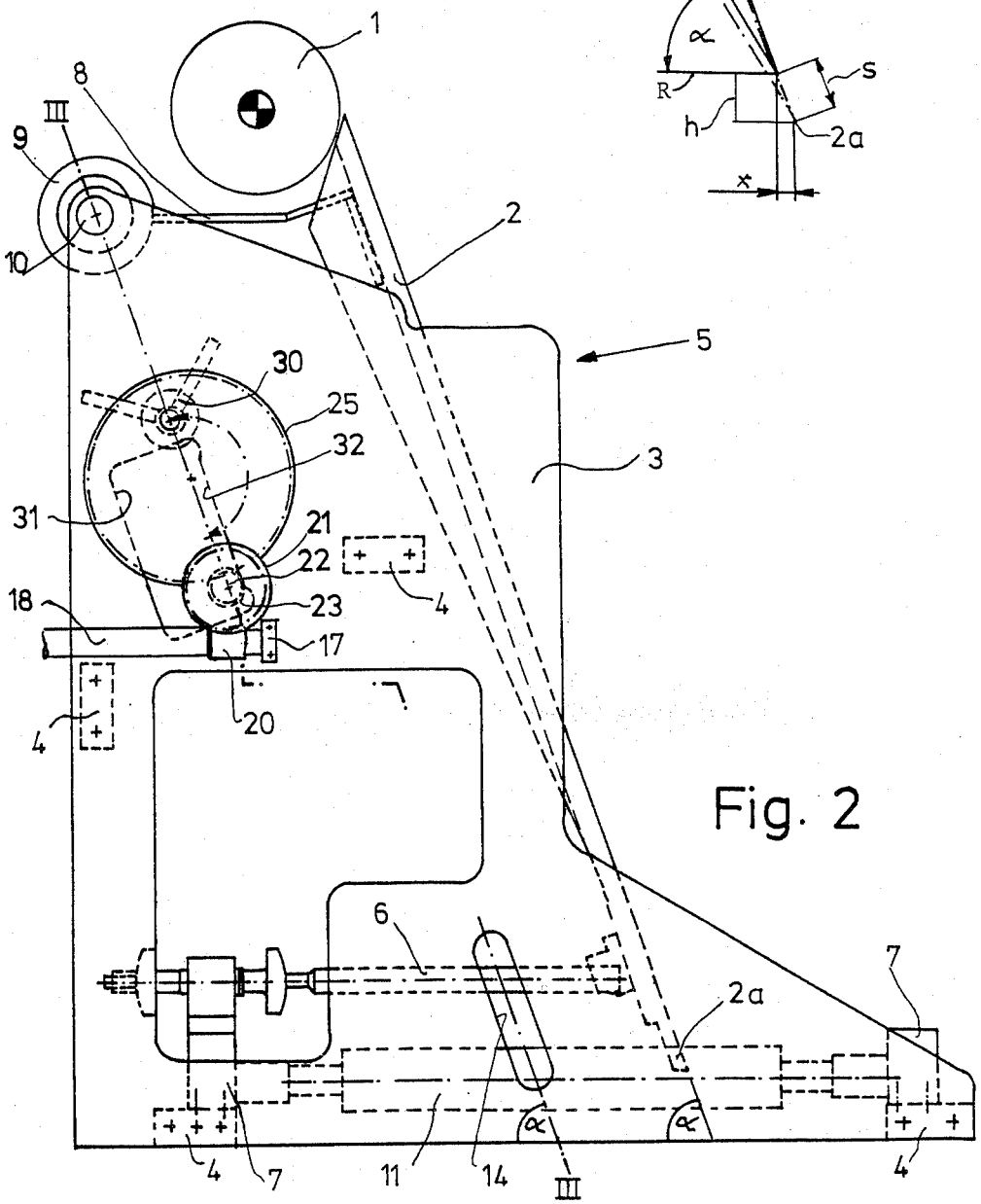
Fig. 2

ADJUSTABLE PAPER WEB FOLDING FORMER

The present invention relates to a folding former for longitudinally folding substrates about a crease line, and more particularly to paper web substrates received from a rotary printing machine.

BACKGROUND

Folding formers are frequently used in paper handling apparatus associated with printing machines to generate a longitudinal fold in a substrate web, typically a paper web. Some special type of printed copy products which are to be made from the web received, by subsequent paper handling, require the formation of subsequent transverse folds, longitudinal folds and the like. Association of a folding former, as well known, with subsequent paper handling apparatus, frequently requires a shift of the folding former triangle of one or more paper webs being applied to the longitudinal apparatus which includes the folding former.

The shift of the folding former is desired to offset the tip of the folding triangle or folding funnel or former apparatus in a horizontal direction, transverse to the axis of an inlet roller; in other words, the crease line generated by the folding former is to be lifted, or depressed, that is, is to be adjustably arranged with respect to the former run-on or web supply roller. In accordance with a prior construction, for example as used in printing machines of the type "ROTOMAN" (trademark), manufactured by the Assignee of the present application, the tip of the folding former can be horizontally shifted. This requires repositioning of the run-on or supply roller as well, since the entire folder is shifted; this shift of the supply roller changes the angle about which the paper web is looped, thus changing the tensioning relationships of the paper web. The former run-on or supply roller is a driven roller, coupled to the drive system of the printing machine from which the web is derived. Thus, shifting the supply roller is comparatively complex and requires subsantial structural modifications. In some constructions, it has been found suitable to provide a separate supply or run-on roller if only one of several folding formers are to be shifted.

Shift of only one of a plurality of, for example parallel folding formers, is sometimes desirable, or required, so that the supplied webs will have different ridge positions, thus permitting grippers to more readily engage the respective folded webs which, as part of the folding operation, may also be slit or separated into parallel strips. Slitting and cutting apparatus, combined with folding formers, are well known.

THE INVENTION

It is an object to provide a substrate handling apparatus, including a folding former in which the fold or ridge line of the folded substrate can be readily repositioned, without requiring substantial changes in an apparatus, change in tension conditions of the substrate web and handling of heavy structural components, such as cylinders or rollers of a rotary printing machine. The substrate webs, typically, are paper; the apparatus, however, is equally applicable for use with other substrates, such as plastic films, fabric, or the like.

Briefly, the folding former is so retained in the printing machine that it can be shifted along the direction of its inclination. Usually, folding formers are located at an inclination with respect to a horizontal plane, which will be termed a reference plane. By shifting the folding former along the angle line or plane of inclination, the wrap, or looping angle of the web being passed over the run-on or supply roller does not change, so that tension conditions of the supplied web will not change; additionally, the former can easily be shifted by providing a guide track for the former, along which it can operate, to be shifted either by fixed distances, or by selectively adjustable distances. Due to the angle of inclination, the tip of the folding former will move horizontally, thus providing the desired offset for the crease line—or, if a slitter is also used, the slitting line of the folded substrate web.

The system has the advantage that the angle of the web which runs on the former and runs off the former is not changed, so that the looping angle about the supply roller will not change, but remain constant. No driven elements need be moved, so that the overall construction of the adjustable former is substantially simplified with respect to prior arrangements. If a plurality of adjacently located former triangles are used, a single run-on roller is all that is required. Since the angle of the substrate web remains the same, only the position of the tip of the former being adjustable.

DRAWINGS

FIG. 1 is a schematic diagram illustrating the shift path of a former triangle along the angle of inclination thereof;

FIG. 2 is a logitudinal, partly cut-away view of the former and its holding apparatus;

DETAILED DESCRIPTION

FIG. 1 illustrates a run-on or web supply roller 1, which is driven, for example, from the main drive of a printing machine. A substrate web W is looped in part about the circumference of roller 1, engaging the roller 1 over a predetermined looping or wrap angle $\beta$. Preferably, a presser roller 1*a* engages the substrate web in the region of the wrap angle. The substrate web need not be a single web, but may be a group of superposed webs, to form a package.

The former apparatus includes a former triangle 2, which has a ridge line 2*a*. The ridge line 2*a* of the folding triangle 2 is inclined with respect to a horizontal or reference plane R by an angle of inclination $\alpha$. So far, the arrangement is based on standard construction.

In accordance with a feature of the present invention, the former triangle 2 can be shifted along the ridge line at the angle $\alpha$, up or down; as schematically indicated by the arrow 2*b*, a shifted position of the former is shown in chain-dotted lines in FIG. 1 at 2'.

FIG. 1 clearly shows that a shift of the former triangle 2 from the full line position to the position shown at 2' does not change the wrap angle $\beta$ about the run-on roller 1. FIG. 1 further clearly shows the relationship between the horizontal offset x of the tip of the folded triangle, the shift path s of the former triangle when being shifted at the inclination angle $\alpha$, and the respective dimensional relationships in accordance with the formula:

$$x = s \cdot \cos \alpha. \quad (1)$$

The overall height of the folding apparatus is increased by the value h as follows:

$$h = x \cdot \tan \alpha. \quad (2)$$

A typical value of an angle $\alpha$ is about 70°, which results in an increase in height h of about 15 cm to obtain an offset x of about 5 cm. The increased height of 15 cm is negligible in apparatus of this type.

Figure 3:
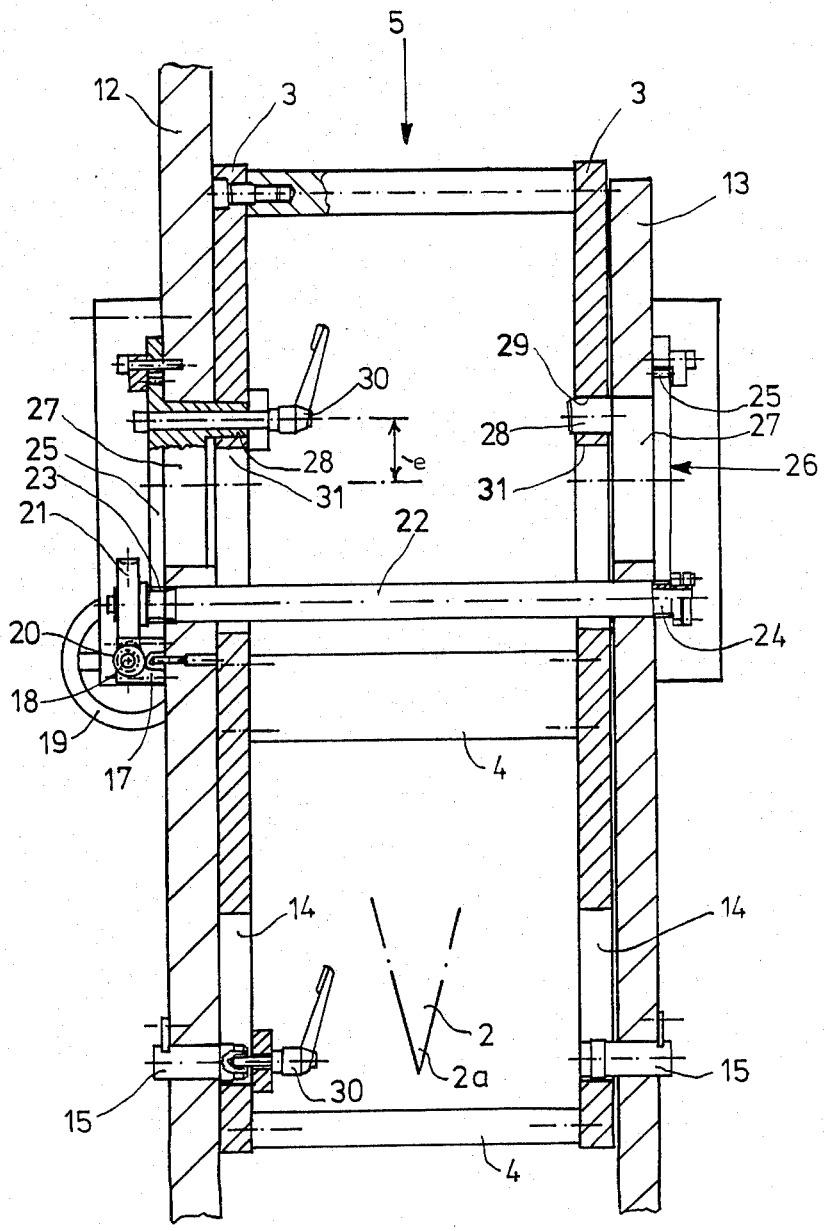
FIG. 3 is a cross-section along the offset section line III—III of FIG. 2.

The structure to obtain the effect, in accordance with the present invention, is best seen in FIGS. 2 and 3, to which reference is now made:

The folding former triangle 2 is positioned in a frame 5 located between sidewalls 12,13 of a suitable support structure, for example of the printing machine. The run-on or supply roller 1, and the counter roller 1*a* are fixed and secured in the sidewalls 12,13. The present invention permits their retention, without any adjustment upon change of the dimension x (FIG. 1). Roller 1 is driven.

The frame 5 is formed by sidewall elements 3 and cross elements, for example cross rods or rails 4. The folding former triangle has a tip 2*a*. The folding former triangle is retained in the frame by an adjustment apparatus 6, well known and standard in the field, to permit fine adjustment of the angle $\alpha$. The fine adjustment apparatus, for example, a spindle-nut arrangement, is held in bearing blocks 7, secured to the frame 5. The angle of inclination $\alpha$, thus, can be adjusted by moving the lower portion of the former triangle to the right or to the left—with respect to FIG. 2—as well known. The folding former triangle 2 is retained in its upper region by a linkage 8, secured to the backside thereof, which, in turn, is coupled to a tube 9 which is rotatable about a shaft 10, extending transversely across the frame 5. Additional components, which are also used for longitudinal folding of a web, such as a run-out roller 11 (shown only in FIG. 2), for example retained in the bearing blocks 7, and other apparatus not specifically shown and well known, such as perforating apparatus, slitter apparatus and the like, are also secured to the frame 5.

In accordance with a feature of the invention, the frame 5 is so retained in the sidewalls 12,13 of the folding apparatus that it can be shifted in the direction of inclination of the folding former triangle. To permit such shift, the lower portion of the sidewalls 3 of the frame 5 have elongated recesses, or through-holes 14 formed therein, which are engaged by projecting elements, such as projecting bolt stops 15, secured to the sidewalls 12,13—see FIG. 3. The longitudinal axis of the guide 14 extends parallel to the angle of inclination $\alpha$, as best seen in FIG. 2.

The shifting movement is transferred to the frame 5 by a positioning spindle 18. Spindle 18 is retained in bearing blocks 17, secured to sidewall 12. A hand wheel 13 is coupled to the spindle 18 to permit ready rotation thereof. The other end of the spindle has a worm 20 arranged thereon, which is engaged by a worm wheel 21. A transversely extending shaft 22, forming a synchronizing is journalled in the sidewalls 12,13. Gears 25 of two gear wheels 26 are engaged by pinions 23,24, which are journalled in the sidewalls 12,13 by an offset flange 27. The inside of the gears 26 are formed with an eccentrically positioned stub 28. The stubs 28 engage bores 29 formed in the sidewalls 3 of the frame 5.

Upon rotation of the gears 26 by 180°, frame 5 is tilted, which results in a shift over the distance s (FIG. 1), corresponding to double the eccentricity e of the stub 28 on the gear 26 with respect to the center of rotation of the gear 26. The resulting horizontal shift x is defined by formula (1) above, wherein $\alpha$ defines the angle of inclination of the forming folder triangle with respect to a horizontal reference line or plane R (see FIG. 1).

The frame 5 is secured with respect to the sidewalls 12,13 when in its terminal positions by clamps 30 screwed into the stubs 28 on the gears 26, and, preferably, also by similar clamps 30 screwed into the stub bolts 15 (see FIG. 3). Openings 31 are formed in the sidewalls 3 of the frame 5 to permit the frame 5 to pivot or tilt about the synchronizing shaft 22. An edge 32 of the opening 31 is formed with a finished surface. The frame engages the edge 32 before and after the folding former triangle has been shifted in position. The edge 32 precisely determines the shifting path.

The embodiment just described is based on an apparatus which requires only two determined positions of the folding former triangle 2. Such an arrangement is suitable, for example, for a plurality of adjacently located folding formers and, especially, if one of the folding formers is to be shifted independently of another one. The longitudinal folds formed by the formers will, thus, appear slightly offset, and can be supplied conjointly to a subsequently located transverse folding apparatus, for transverse folding. The lateral offset provides engagement surfaces for grippers, or other material handling apparatus which may be used, downstream of the folding former, and for example after severing folded webs, which severing apparatus may utilize grippers.

Other types of material handling, for example introduction of a third fold, forming a second longitudinal fold by a second, fixed folding triangle and located transversely to the first folding former triangle, may, however, require a stepless, continuous repositioning of the first folding triangle. This, for example, may be required if a web is to be printed with repetitively occurring subject matter, that is, with fixed format, in which, however, the web or substrate width varies. Such a folding arrangement also is suitable if only a single folding former is placed downstream of a paper handling machine, typically a printing machine, in which it is desirable to vary the position of the folding former without changing the wrap angle $\beta$, and the operating conditions of the paper handling apparatus.

Figure 4:
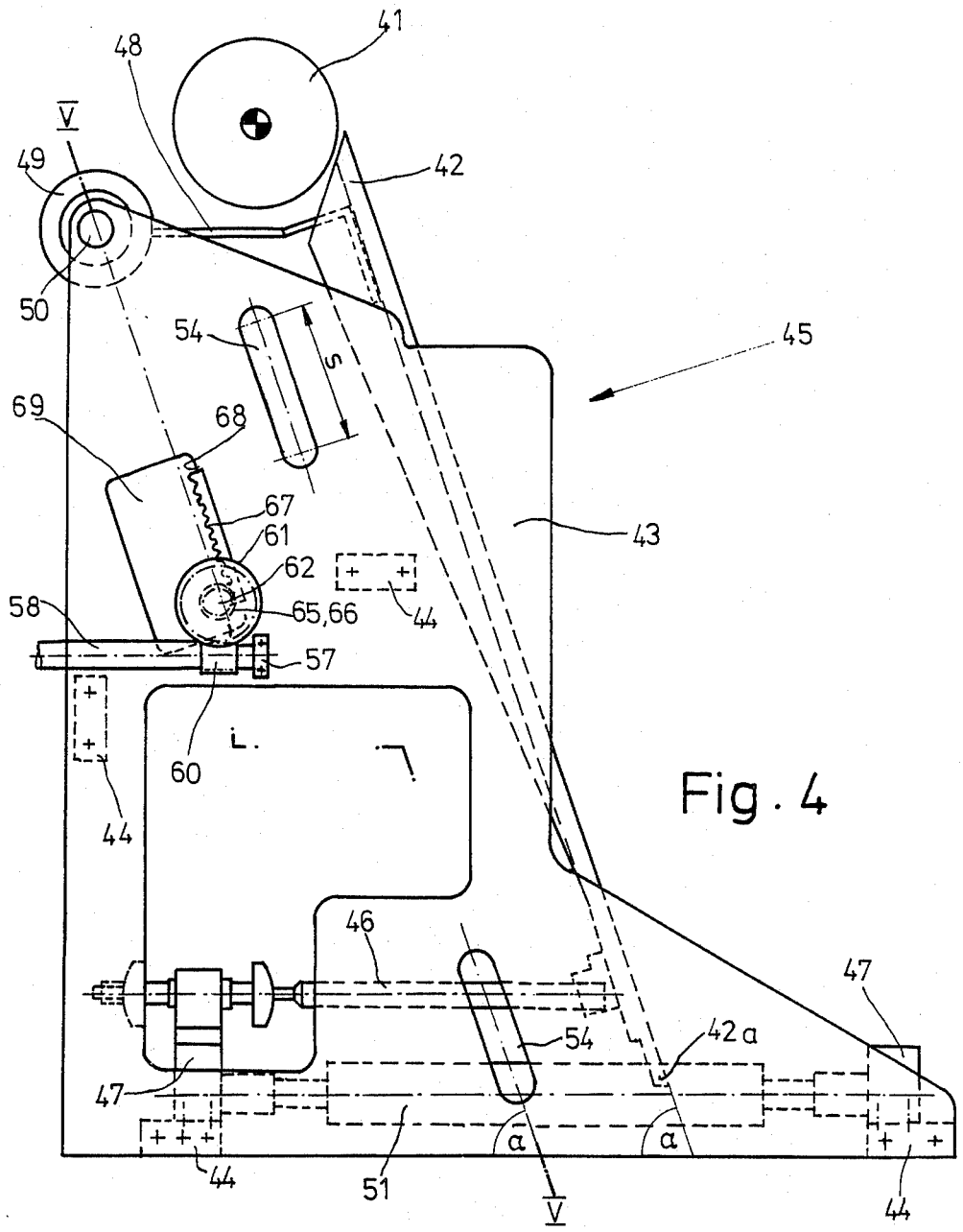
FIG. 4 is a view similar to FIG. 2, and illustrating a modified arrangement of the shifting section.
Figure 5:
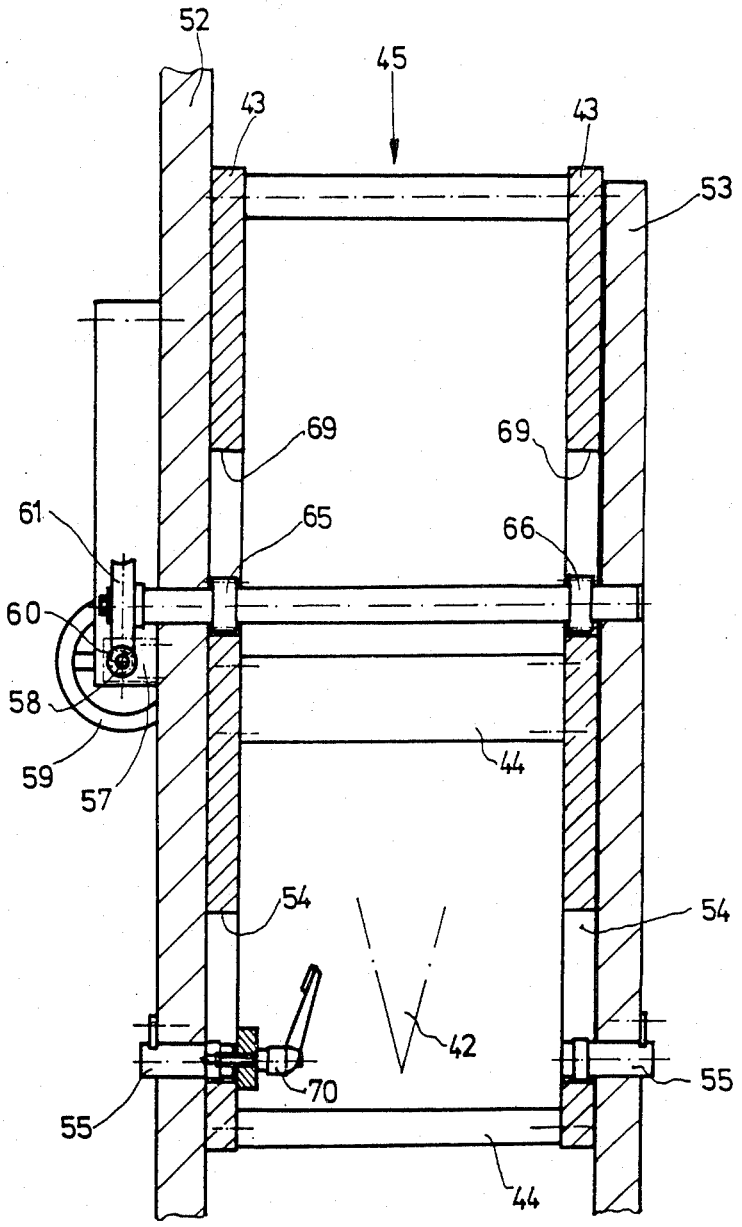
FIG. 5 is a section along the offset section line V—V of FIG. 4.

FIGS. 4 and 5 illustrate another solution to shift the folding former triangle along the plane, or line of inclination defined by the angle $\alpha$. Rather than providing a fixed shifting path, determined by the eccentricity e, a continously variable shifting path is provided.

Elements similar to those already described have been given the same reference numeral, incremented, however, by 40. The run-in roller 41 is located between sidewalls 52,53. The folding former triangle 42 is located in a frame 45, formed by sidewalls 43 and cross elements 44. Close to the tip 42*a* of the folding former triangle 42, a fine positioning apparatus 42 is pivotably connected, which is axially adjustably located in bearing blocks 47, secured to the frame 45. This arrangement is standard, and well known to those skilled in the art, and need not be described in detail.

The folding former triangle 42 is secured by links 48 and a tube 49 on a shaft 50 secured to the frame 45, so that the tube 49 can rotate with respect to the shaft 50.

Other elements, such as the run-out roller 51, perforating slitting apparatus and the like, and customarily coupled to the folding former triangle are also secured to the frame 45.

Frame 45 is so retained in the sidwalls 52,53 of the apparatus that it can be shifted in direction of the angle of inclination. Two guide recesses, for example through-openings 54, are formed in the sidewalls, having a common longitudinal axis and extending parallel to the angle of inclination of the folding former triangle. Projecting stub bolts 55 engage in the recesses or openings 54. The stub bolts 55 have a diameter which is only slightly less than the width of the guide openings 54. The guide openings 54 terminate in semicircular end portions which, in combination with the circular cross-section of the bolts 55, form stroke limits for the shift path of the frame 45.

Shift of the folding former 42 is controlled by a positioning spindle 58, retained in bearing blocks 57 located on the sidewall 52. A hand wheel 59 is engaged with spindle 58 for ease of operation. A worm 60 is coupled to the other end of spindle 58. A worm wheel 61, engaging the worm 60, is secured to a synchronizing shaft 62, journalled on the sidewalls 52,53 of the structure.

In accordance with the embodiment of the invention illustrated in FIGS. 4 and 5, two pinions 65,66 are located in the region of the sidewalls 43 of the frame 45. Pinions 65,66 are coupled to the synchronizing shaft 62 and mesh with rack element 67. The rack element 67 may be machined in an essentially rectangular recess 69, formed with an edge portion 68 and extending parallel to the inclination angle $\alpha$. The recesses 69 are located in each one of the sidewalls 43 of the frame 45. The rack element can be machined directly into the sidewalls 43 or may be formed by a separate rack strip which is secured to the sidewalls 43, as desired.

The arrangement permits stepless, continuous adjustment of the folding former triangle. The maximum adjustment path or distance is defined by the length of the openings 54. Folding former 42 can be locked in any desired position by clamps 70, secured to the insides of the sidewalls 43 of the frame 45, and clamping the respective sidewalls 43 of the frame against the sidewalls of the apparatus 52,53, for example the sidewalls of a printing machine. Only one clamp is shown in FIG. 5 for ease of illustration.

Various changes and modifications may be made, and features described in connection with any one of the embodiments may be used with the other, within the scope of the inventive concept.

I claim:

1. Adjustable folding former apparatus having a folding former triangle (2,42) positioned at a predetermined angle of inclination ($\alpha$) with respect to a fixed reference plane (R);

a driven substrate supply roller means (1,41) located at a run-on side of the triangle;

a folded substrate removal roller means (11,51) located at a run-out side of said triangle, and comprising, in accordance with the invention, folding former triangle support means (5,6;45,46) retaining the folding former triangle in position at said angle of inclination ($\alpha$) while permitting shifting of said folding former triangle, with respect to said reference plane, along a plane positioned at said angle of inclination.

2. The apparatus of claim 1, wherein substrate removal roller means (11,51) are provided movably supported for shifting movement conjointly with shifting of said folding former triangle (2,42).

3. The apparatus of claim 1, wherein said support means (5,6;45,46) comprises a frame (5,45) including sidewalls (3,43) and cross connecting support means (4,44) connecting said sidewalls;

and inclination adjustment means (6,46) are provided, secured to said frame for adjusting the inclination of the folding former triangle with respect to said frame;

and further including fixed sidewalls (12,13;52,53), shiftably retaining said frame between said sidewalls for movement in said plane positioned at said angle of inclination.

4. The apparatus of claim 3, wherein said substrate removal roller means (11,51) are movably supported for shifting movement conjointly with shifting of said folding former triangle(2,42);

and wherein said removal rollers are supported on said frame (5,45).

5. The apparatus of claim 3, wherein said fixed apparatus sidewalls (12,13;52,53) are formed with recess means (54) extending therein at least approximately at said angle of inclination ($\alpha$) with respect to said reference plane (R);

and wherein said frame is formed with projecting means (15,55) projecting from the frame and engageable with said recess means.

6. The apparatus of claim 5, wherein said recess means comprise elongated openings (14,54) formed in said fixed apparatus sidewalls (12,13,52,53) and said projecting means comprise laterally projecting bolts or stubs or pins extending from said frame and fitted in said elongated openings.

7. The apparatus of claim 5, wherein (FIGS. 1,2) adjustment means for positioning the folding former triangle in respectively shifted position are provided, said adjustment means comprising two gears (12,13) having aligned axes and having connecting means (28) located thereon, offset by a predetermined eccentricity (e) with respect to the axis of the aligned gears;

reception means (29) movably receiving said connecting means (28);

a synchronizing shaft (22) connecting the fixed apparatus sidewalls, and gear pinion means (23,24) meshing with said gear means;

and operating means (19,20,21) secured to the fixed apparatus sidewalls, for rotating said synchronizing shaft (22).

8. The apparatus of claim 7, wherein said operating means comprises a worm and worm-gear connection, coupled to said synchronizing shaft; and a hand wheel (19) for operating said worm-gear connection.

9. The apparatus of claim 3, further including two pinions secured to the fixed apparatus sidewalls (52,53);

a synchronizing shaft (62) extending transversely across said frame (5,45) and having said pinions (65,66) secured thereto;

a rack element (67) positioned for engagement with said pinions, said rack element being located on the sidewalls (43) of the frame (45) and positioned at said angle of inclination and in engagement with said pinions; and operating means (58,59,60,61) coupled to said synchronizing shaft for rotating said shaft and hence said pinions, and thereby move the frame to which said rack is coupled in said plane positioned at said angle of inclination.

10. The apparatus of claim 9, wherein said operating means comprises a worm and worm-gear connection, coupled to said synchronizing shaft; an a hand wheel (19) for operating said worm-gear connection.

11. The apparatus of claim 9, further including guide recess-and-projection means forming an elongated recess extending along said angle of inclination ($\alpha$) and formed in one of said sidewalls; and projection means formed in the other of said sidewalls and engageable with said recess, for guiding the frame to move in said plane at said angle of inclination.

12. The apparatus of claim 5, wherein said recess has a longitudinal extent sufficient to provide for movement of said folding former triangle in said plane at said angle of inclination over a distance s which, when multiplied with a cosine of said angle of inclination ($\alpha$), provides a required horizontal shift of the tip or apex of the triangle by a required distance (x).

13. The apparatus of claim 11, wherein said recess has a longitudinal extent sufficient to provide for movement of said folding former triangle in said plane at said angle of inclination over a distance s which, when multiplied with a cosine of said angle of inclination ($\alpha$), provides a required horizontal shift of the tip or apex of the triangle by a required distance (x).

* * * * *